US011187483B2

(12) United States Patent
O'Clair

(10) Patent No.: US 11,187,483 B2
(45) Date of Patent: Nov. 30, 2021

(54) SEAR MECHANISM AND FIREARM

(71) Applicant: Smith & Wesson Inc., Springfield, MA (US)

(72) Inventor: Sean O'Clair, Blandford, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 17/064,801

(22) Filed: Oct. 7, 2020

(65) Prior Publication Data

US 2021/0222980 A1 Jul. 22, 2021

Related U.S. Application Data

(60) Provisional application No. 62/912,347, filed on Oct. 8, 2019.

(51) Int. Cl.
*F41A 19/31* (2006.01)
*F41A 19/12* (2006.01)

(52) U.S. Cl.
CPC ..... *F41A 19/12* (2013.01); *F41A 19/31* (2013.01)

(58) Field of Classification Search
CPC ..... F41A 19/17; F41A 19/31; F41A 19/12
USPC ..... 89/144
See application file for complete search history.

(56) References Cited

U.S. PATENT DOCUMENTS

| | | | | |
|---|---|---|---|---|
| 4,590,697 | A | 5/1986 | Ruger et al. | |
| 6,308,448 | B1 * | 10/2001 | Kapusta | F41A 19/31 42/69.02 |
| 8,601,932 | B1 | 12/2013 | Karfiol et al. | |
| 9,644,913 | B2 | 5/2017 | Dextraze | |
| 10,077,961 | B2 | 9/2018 | Carr | |
| 10,126,082 | B2 | 11/2018 | Hudson, III et al. | |

* cited by examiner

*Primary Examiner* — Reginald S Tillman, Jr.
(74) *Attorney, Agent, or Firm* — John Chionchio, Esq.; Ballard Spahr LLP

(57) ABSTRACT

A sear mechanism for a firearm pivotably mounts a sear body on a sear lever which is pivotably mounted on the firearm frame. An actuator lever is also pivotably mounted on the frame. The actuator lever is pivoted by a trigger bar connected to the firearm's trigger. Pivoting of the actuator lever when the trigger is pulled allows the sear lever to pivot. Pivoting of the sear lever allows the sear body to fall off of a surface on a striker, releasing the striker to discharge the firearm.

13 Claims, 10 Drawing Sheets

SEAR MECHANISM AND FIREARM

CROSS REFERENCE TO RELATED APPLICATIONS

This application is based upon and claims benefit of priority to U.S. Provisional Application No. 62/912,347, filed Oct. 8, 2019 and hereby incorporated by reference herein.

FIELD OF THE INVENTION

This invention concerns sear mechanisms for firearms.

BACKGROUND

It is advantageous to increase the performance of fire control systems for firearms by lightening the force required to pull the trigger without sacrificing reliability or the "crispness" of the pull. It is further advantageous to provide tactile feedback to the user to allow for a more measured discharge for improved accuracy. The design and operation of the sear is key to achieving these goals. There is an opportunity to improve firearms through advances in sear mechanism design.

SUMMARY

The invention concerns a sear mechanism for a firearm. The firearm has a frame and a striker. In an example embodiment the sear mechanism comprises a sear lever mountable on the frame for pivoting motion about a lever axis. A stop surface is positioned on the sear lever distal to the lever axis. The stop surface faces the striker. A running surface is positioned on the sear lever distal to the lever axis and facing away from the striker. A contact surface is positioned on the sear lever contiguous with the running surface. The contact surface is angularly oriented with respect to the running surface. A sear body is mounted on the sear lever for pivoting motion about a sear axis distal to the lever axis. An engagement surface is positioned on the sear body distal to the sear axis. The engagement surface faces the stop surface. A sear spring acts on the sear body to bias the engagement surface toward the stop surface. An action surface is positioned on the sear body. The action surface is engageable with the striker. An actuator lever is mountable on the frame for pivoting motion about an actuator axis. A support surface is positioned on the actuator lever in facing relation with the running surface. A ramp surface is positioned on the actuator lever contiguous with the support surface. The ramp surface is angularly oriented with respect to the support surface and is engageable with the contact surface upon pivoting motion of the actuator lever. An actuator spring acts on the actuator lever to bias the ramp surface away from the contact surface.

An example embodiment further comprises a housing mountable on the frame. The sear lever and the actuator lever are pivotably mounted within the housing in this example. When the housing is used the sear spring acts between the housing and the sear body and the actuator spring acts between the housing and the actuator lever. In an example embodiment the ramp surface has an orientation angle complementary to an orientation angle of the contact surface.

The invention also encompasses a firearm. In an example embodiment he firearm comprises a frame. A slide is mounted on the frame and is movable between a position in battery and a position out of battery. A striker is mounted on the slide. The striker defines a striker face facing a muzzle end of the firearm. A sear lever is mounted on the frame for pivoting motion about a lever axis. A stop surface is positioned on the sear lever distal to the lever axis and facing the striker. A running surface is positioned on the sear lever distal to the lever axis and facing away from the striker. A contact surface is positioned on the sear lever contiguous with the running surface. The contact surface is angularly oriented with respect to the running surface. A sear body is mounted on the sear lever for pivoting motion about a sear axis distal to the lever axis. An engagement surface is positioned on the sear body distal to the sear axis. The engagement surface faces the stop surface. A sear spring acts on the sear body to bias the engagement surface toward the stop surface. An action surface is positioned on the sear body. The action surface is engageable with the striker face. An actuator lever is mounted on the frame for pivoting motion about an actuator axis. A support surface is positioned on the actuator lever in facing relation with the running surface. A ramp surface is positioned on the actuator lever contiguous with the support surface. The ramp surface is angularly oriented with respect to the support surface and engageable with the contact surface upon pivoting motion of the actuator lever. An actuator spring acts on the actuator lever to bias the ramp surface away from the contact surface. A trigger is pivotably mounted on the frame. A trigger bar is pivotably linked to the trigger. The trigger bar is movable into engagement with and pivots the actuator lever when the trigger is pulled.

A further example embodiment comprises a housing mounted on the frame. The sear lever and the actuator lever are pivotably mounted within the housing. When the housing is present the sear spring acts between the housing and the sear body and the actuator spring acts between the housing and the actuator lever. In an example embodiment the ramp surface has an orientation angle complementary to an orientation angle of the contact surface. By way of example the striker comprises a shaft and a spur projecting outwardly therefrom. The striker face is positioned on the spur. Further by way of example the actuator lever comprises a tab projecting therefrom. The trigger bar comprises a forcing surface engageable with the tab for pivoting the actuator lever upon motion of the trigger bar. By way of example the firearm may comprise a semiautomatic pistol.

DETAILED DESCRIPTION

Figure 1:
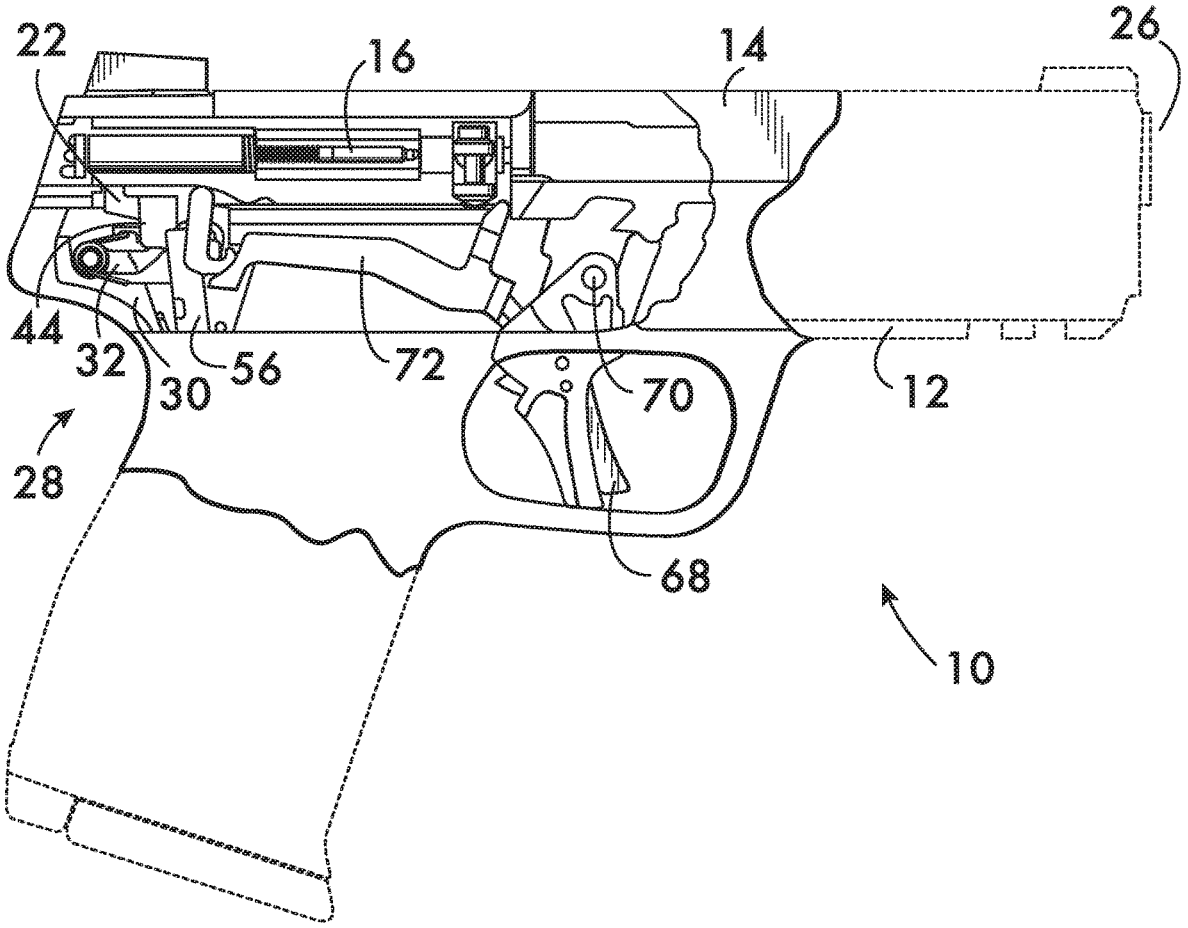
FIG. 1 is a partial cut-away side view of a firearm having a sear mechanism according to the invention.
Figure 2:
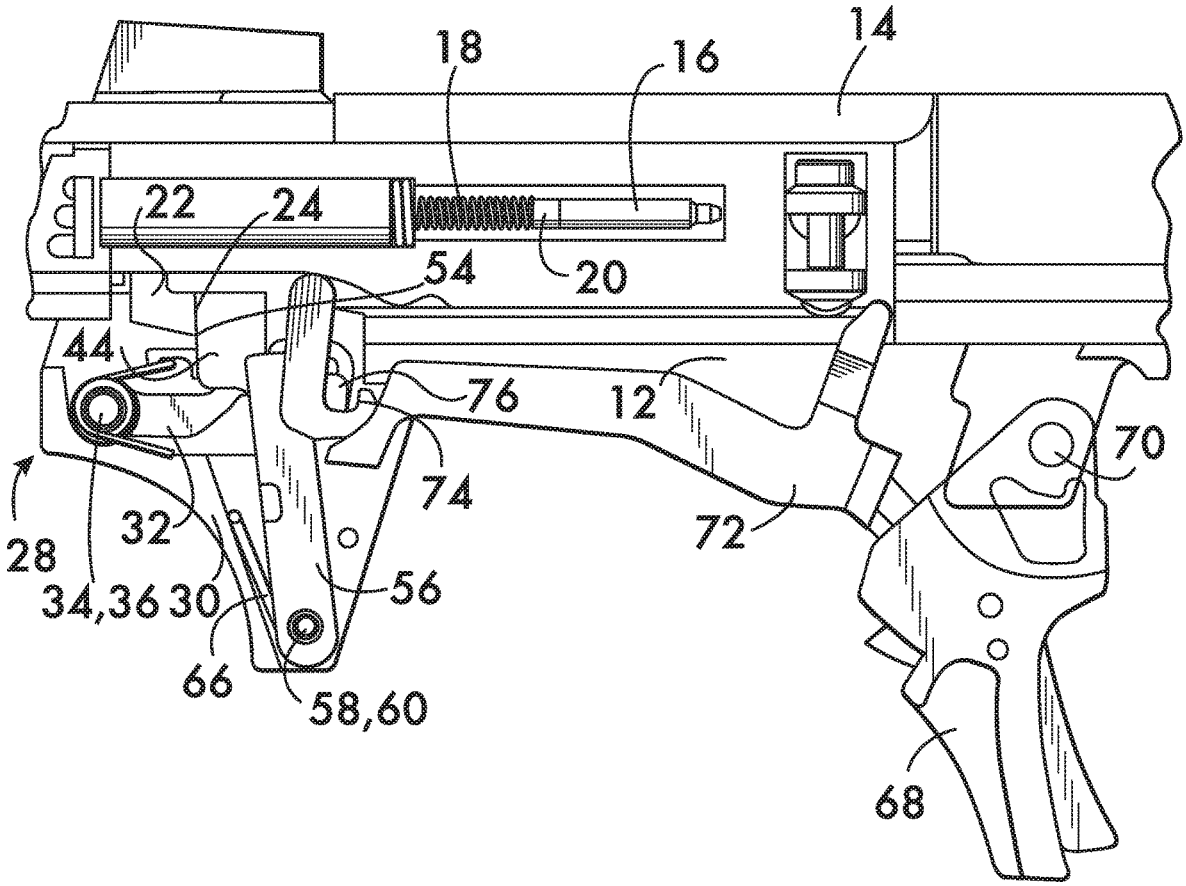
FIG. 2 is a side view showing a portion of the firearm of FIG. 1.

FIG. 1 shows a firearm according to the invention, in this example a semiautomatic pistol 10. Pistol 10 comprises a frame 12 on which a slide 14 is mounted. As is well understood for semiautomatic pistols slide 14 moves between a position in battery (the breech block and barrel locked) and a position out of battery (the breech open). As shown in FIG. 2, a striker 16 is mounted on the slide 14. A striker spring 18 acts between the striker 16 and the slide 14 and drives the striker against the primer of a chambered round (not shown) when the striker is released to discharge the pistol 10. In this example, striker 16 comprises a shaft 20 which forms a firing pin. A spur 22 projects outwardly from shaft 20 and defines a striker face 24 which faces the muzzle end 26 of the pistol 10.

Figure 3:
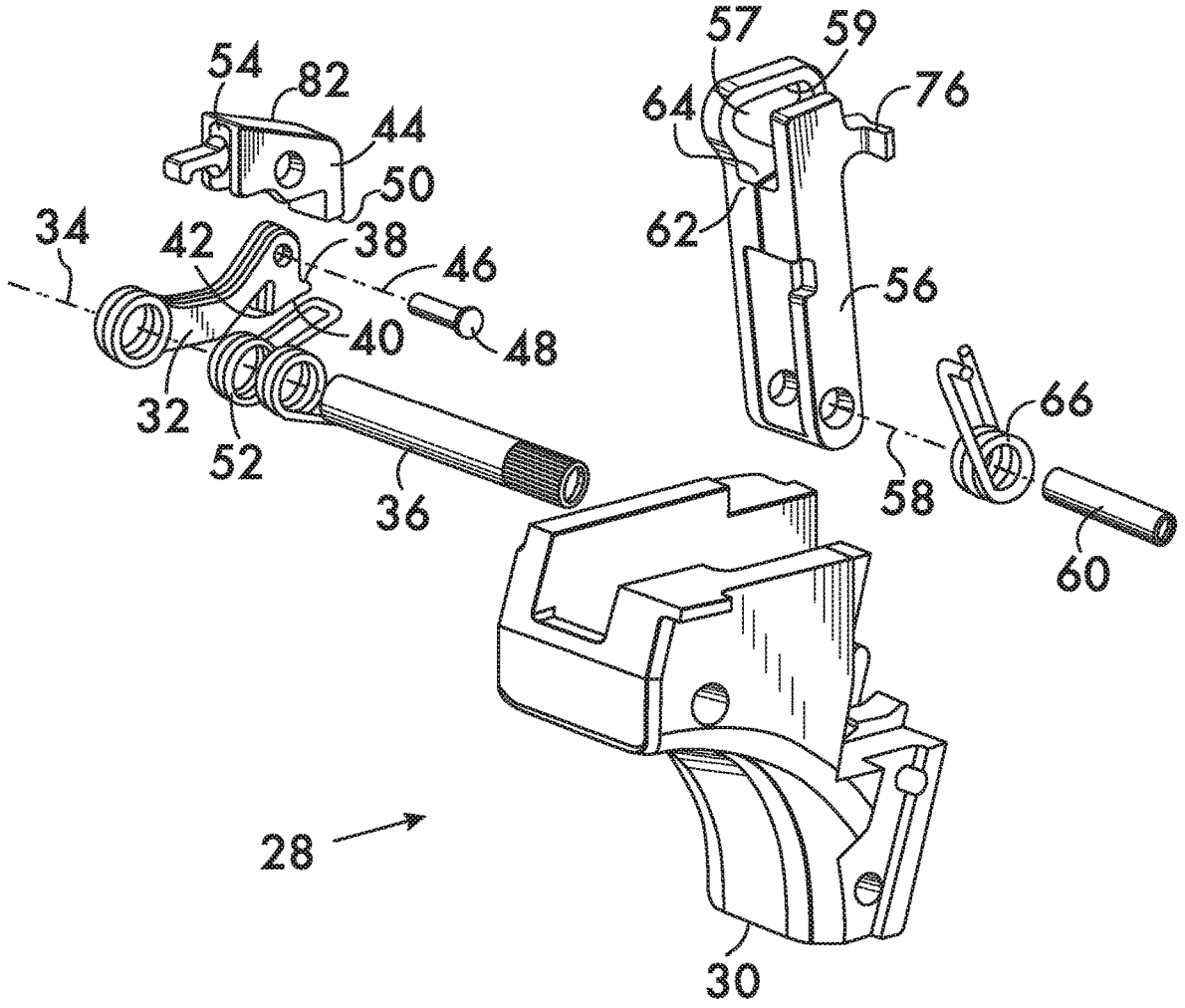
FIG. 3 is an exploded isometric view of an example sear mechanism according to the invention.

FIGS. 2 and 3 illustrate an example sear mechanism 28 according to the invention. The various components of sear mechanism 28 are mounted on frame 12 and may be mounted directly, or, as shown in FIGS. 2 and 3, mounted within a housing 30 which is mounted on the frame. In this specification the term "mounted on the frame" refers to both directly mounting a component on the frame or indirectly mounting a component on the frame via an intermediate structure such as housing 30.

Figure 4:
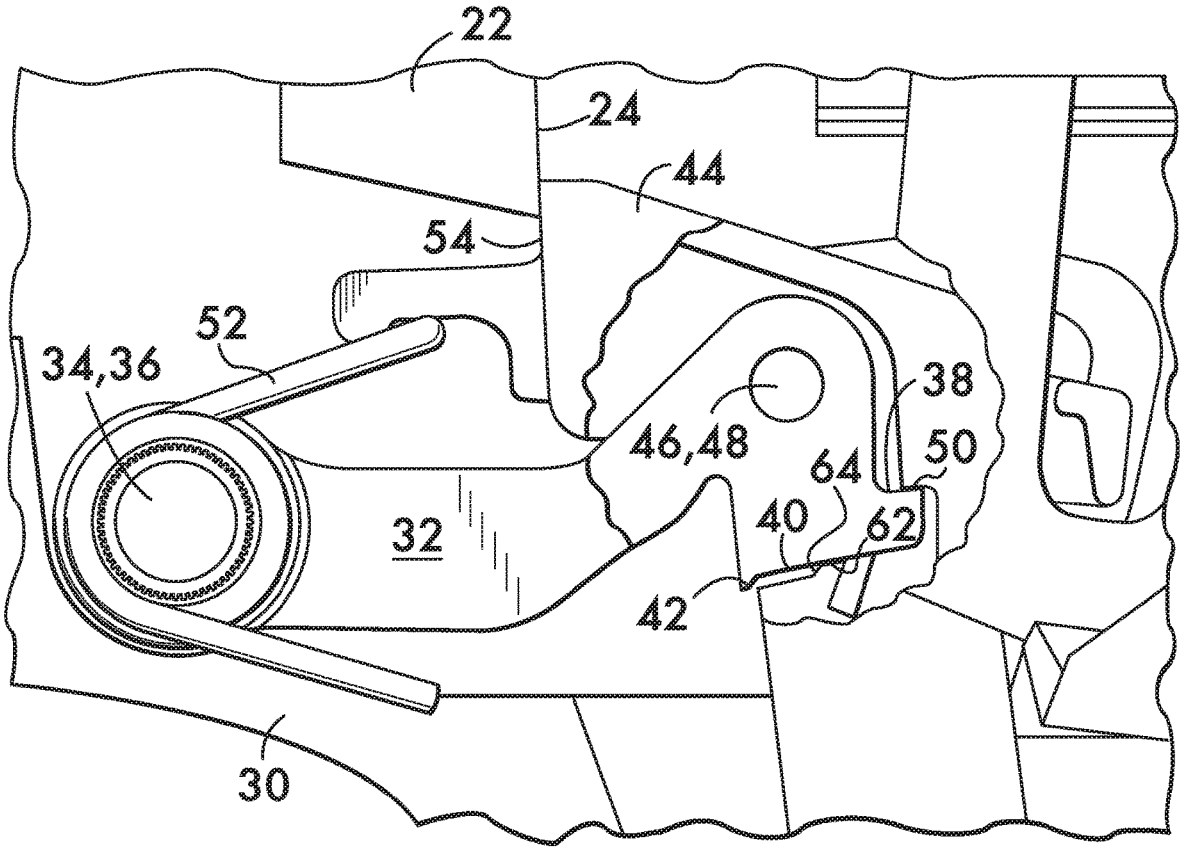
FIG. 4 is a side view showing various components of the example sear mechanism according to the invention on an enlarged scale.
Figure 5:
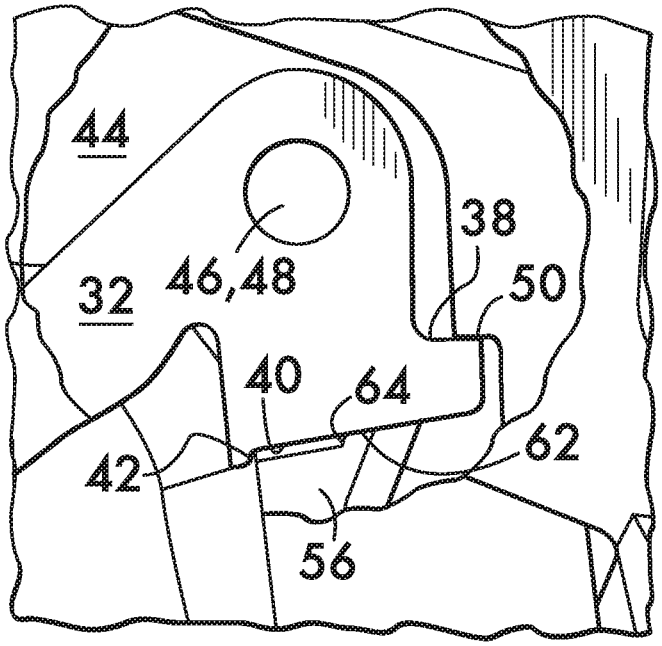
FIG. 5 is a side view showing various components of the example sear mechanism according to the invention on an enlarged scale.

A sear lever 32 is mounted on the frame 12 for pivoting motion about a lever axis 34 defined by a mounting pin 36. As shown in FIGS. 3 and 4, a stop surface 38 is positioned on the sear lever 32 distal to the lever axis 34. Stop surface 38 faces the striker 16 (see also FIG. 1). As shown in FIGS. 4 and 5, a running surface 40 is positioned on the sear lever 32, also distal to the lever axis 34 but facing away from the striker 16. A contact surface 42 is positioned on the sear lever 32 contiguous with the running surface 40. The contact surface 42 is angularly oriented with respect to the running surface 40.

With reference to FIGS. 3 and 4, a sear body 44 is mounted on the sear lever 32. Sear body 44 is pivotably mounted for pivoting motion about a sear axis 46 positioned distal to the lever axis 34. Sear axis 46 is defined by a mounting pin 48. An engagement surface 50 is positioned on the sear body 44 distal to the sear axis 46. Engagement surface 50 faces the stop surface 38 on the sear lever 32 and is biased toward the stop surface by a sear spring 52 acting on the sear body 44. In this example the sear spring 52 acts between the housing 30 and the sear body 44. As shown in FIGS. 2 and 3, an action surface 54 is positioned on the sear body 44. Action surface 54 is engageable with the striker face 24. Engagement between the sear action surface 54 and the striker face 24 holds the striker 16 in the cocked position shown (striker spring 18 compressed), the striker being released when the sear action surface 54 falls off of the striker face 24 during mechanism operation as described below.

As shown in FIGS. 2 and 3, an actuator lever 56 is mounted on the frame 12 (via housing 30) for pivoting motion about an actuator axis 58. Axis 58 is defined by a mounting pin 60. Mounting pin 48 of sear body 44 extends proud of the sear body and into an opening 57 defined by the actuator lever 56. Surface 59, which forms part of the perimeter of opening 57, acts as a stop to limit the counterclockwise rotation of the sear lever 32 under the force of the sear spring 52 when spur 22 is not engaged with action surface 54 on the sear body 44. As shown in FIG. 5, a support surface 62 is positioned on the actuator lever 56 in facing relation with the running surface 40 on the sear lever 32. A ramp surface 64 is positioned on the actuator lever 56 contiguous with the support surface 62. Ramp surface 64 is angularly oriented with respect to the support surface 62 and is engageable with the contact surface 42 on the sear lever 32 upon pivoting motion of the actuator lever 56. Advantageously, the ramp surface 64 has an orientation angle complementary to an orientation angle of the contact surface 42 to permit the surfaces to slide over one another during mechanism operation. An actuator spring 66 (see FIG. 3) acts on the actuator lever 56 to bias the ramp surface 64 away from the contact surface 42. In this example the actuator spring acts between the housing 30 and the actuator lever 56 as shown in FIG. 2.

As shown in FIGS. 1 and 2, a trigger 68 is pivotably mounted on the frame 12 for pivoting motion about a trigger axis 70. A trigger bar 72 is pivotably linked to the trigger 68. Trigger bar 72 is movable into engagement with the actuator lever 56 when the trigger 68 is pulled to pivot the actuator lever counterclockwise and force engagement between the ramp surface 64 of the actuator lever and the contact surface 42 of the sear lever 32. In this example embodiment, engagement between the trigger bar 72 and the actuator lever 56 is effected via a forcing surface 74 on the trigger bar contacting a tab 76 extending from the actuator lever when trigger 68 is pulled as shown in FIG. 6.

Operation of the sear mechanism 28 is described with reference to FIGS. 1-11. FIGS. 1 and 2 show the pistol 10 with the slide 14 in battery and the striker 16 cocked. The striker 16 is held in the cocked position by engagement between the striker face 24 on spur 22 and the action surface 54 of the sear body 44. The compressed striker spring 18 applies a force against the sear's action surface 54 via spur 22 (note also, in FIG. 4, contact between the sear lever's stop surface 38 and the sear body's engagement surface 50) which would tend to rotate the sear lever 32 clockwise about lever axis 34 if, as shown in FIG. 4, the sear lever 32 were not restrained against rotation by engagement between the running surface 40 on the sear lever 32 and the support surface 62 on the actuator lever 56.

Figure 7:
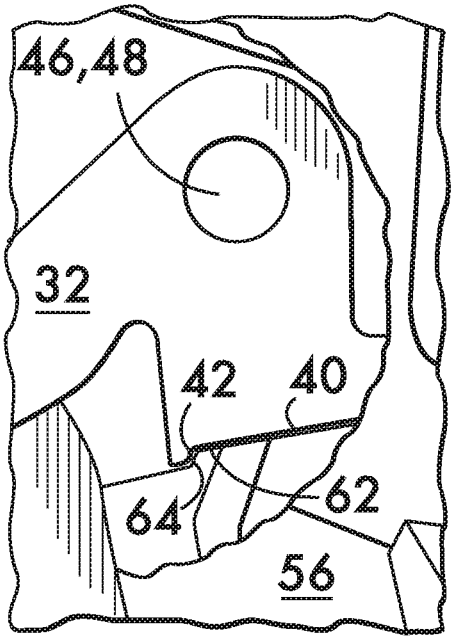
FIG. 7 is a side view showing various components of the example sear mechanism according to the invention on an enlarged scale.
Figure 6:
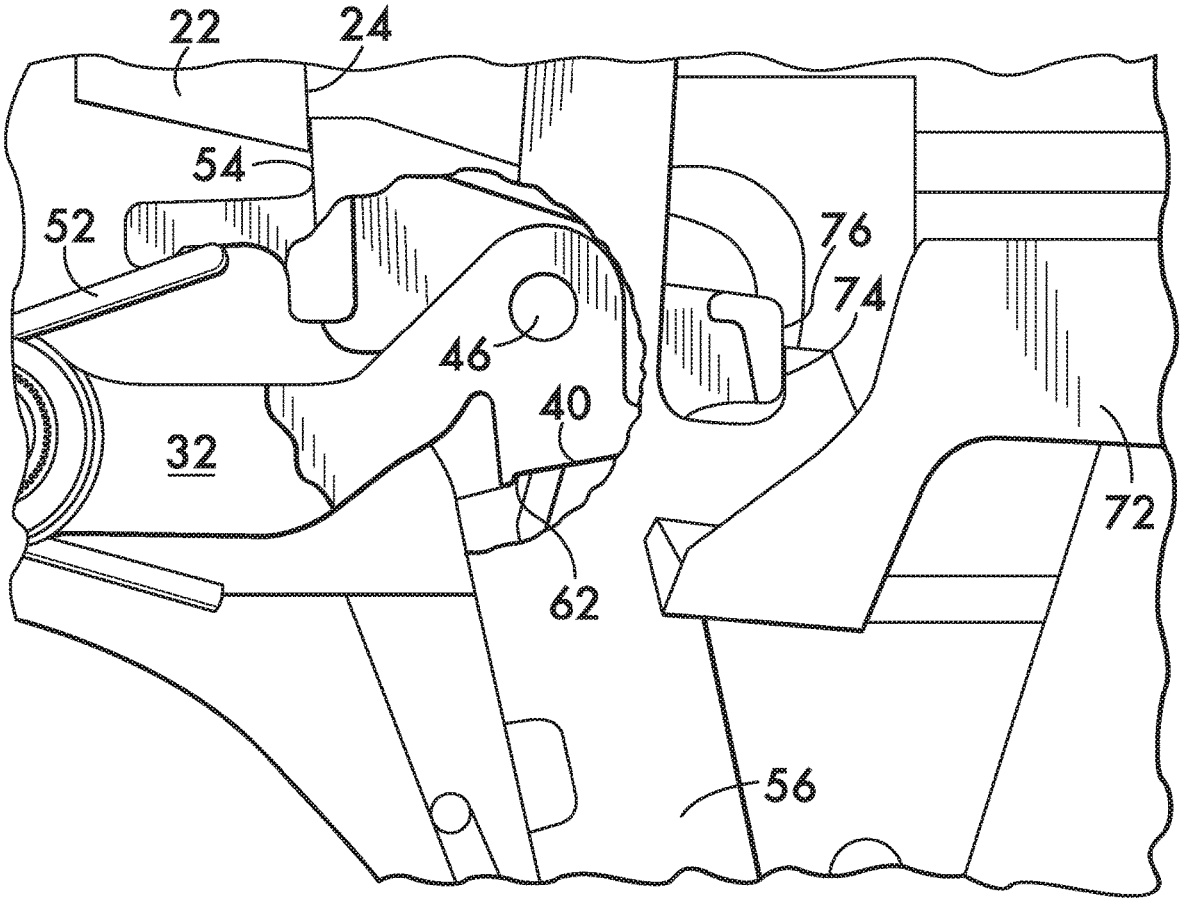
FIG. 6 is a side view showing various components of the example sear mechanism according to the invention on an enlarged scale.
Figure 8:
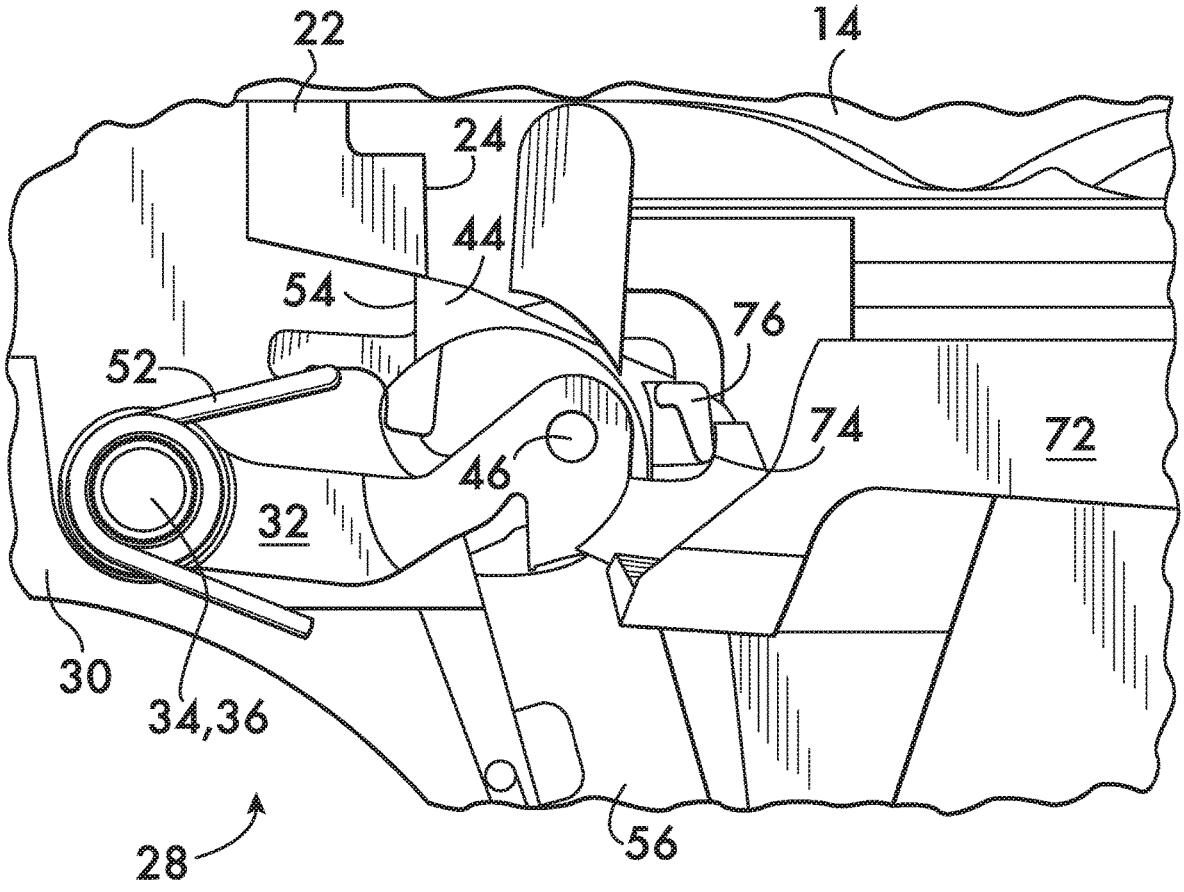
FIG. 8 is a side view showing various components of the example sear mechanism according to the invention on an enlarged scale.
Figure 9:
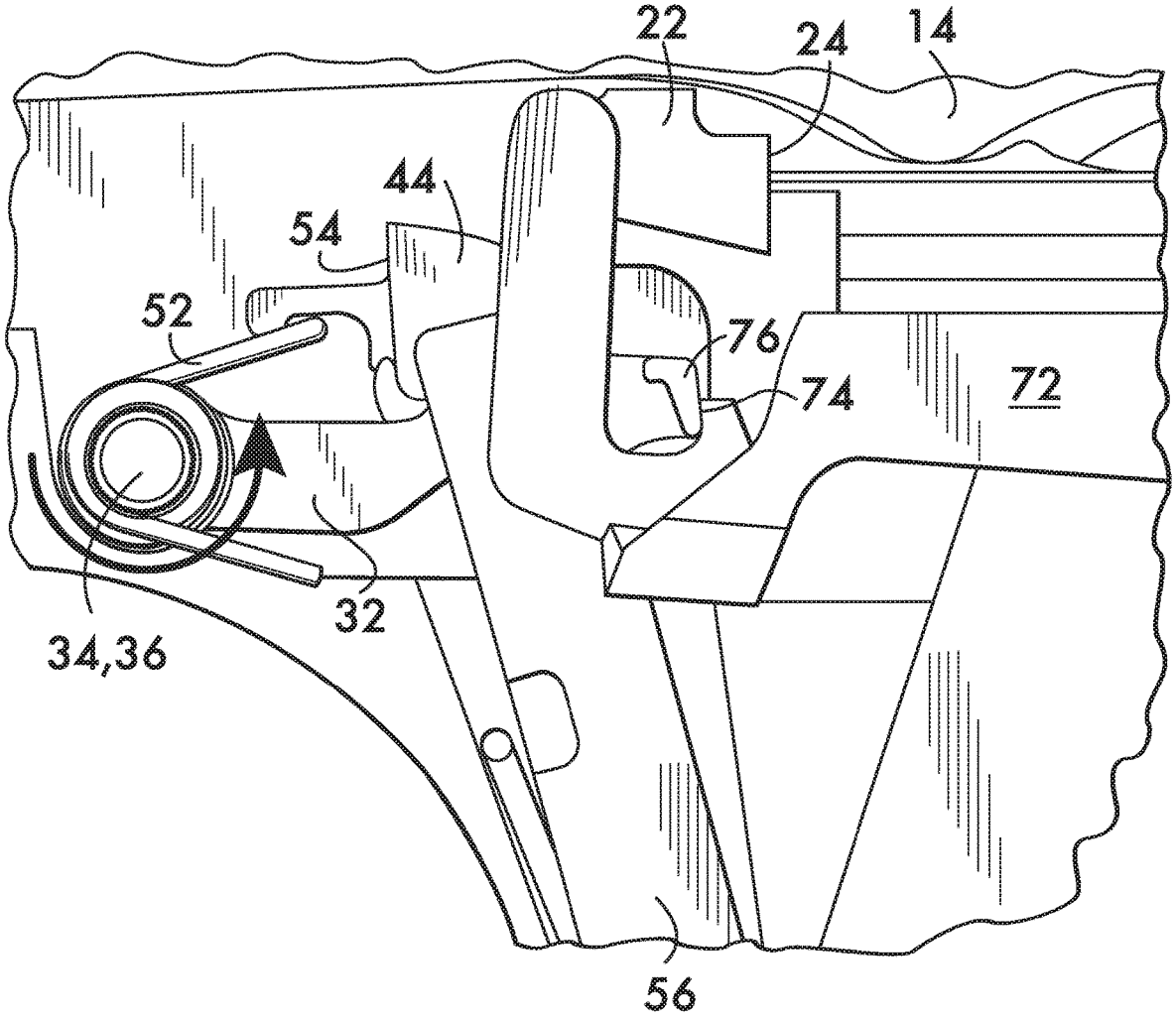
FIG. 9 is a side view showing various components of the example sear mechanism according to the invention on an enlarged scale.
Figure 10:
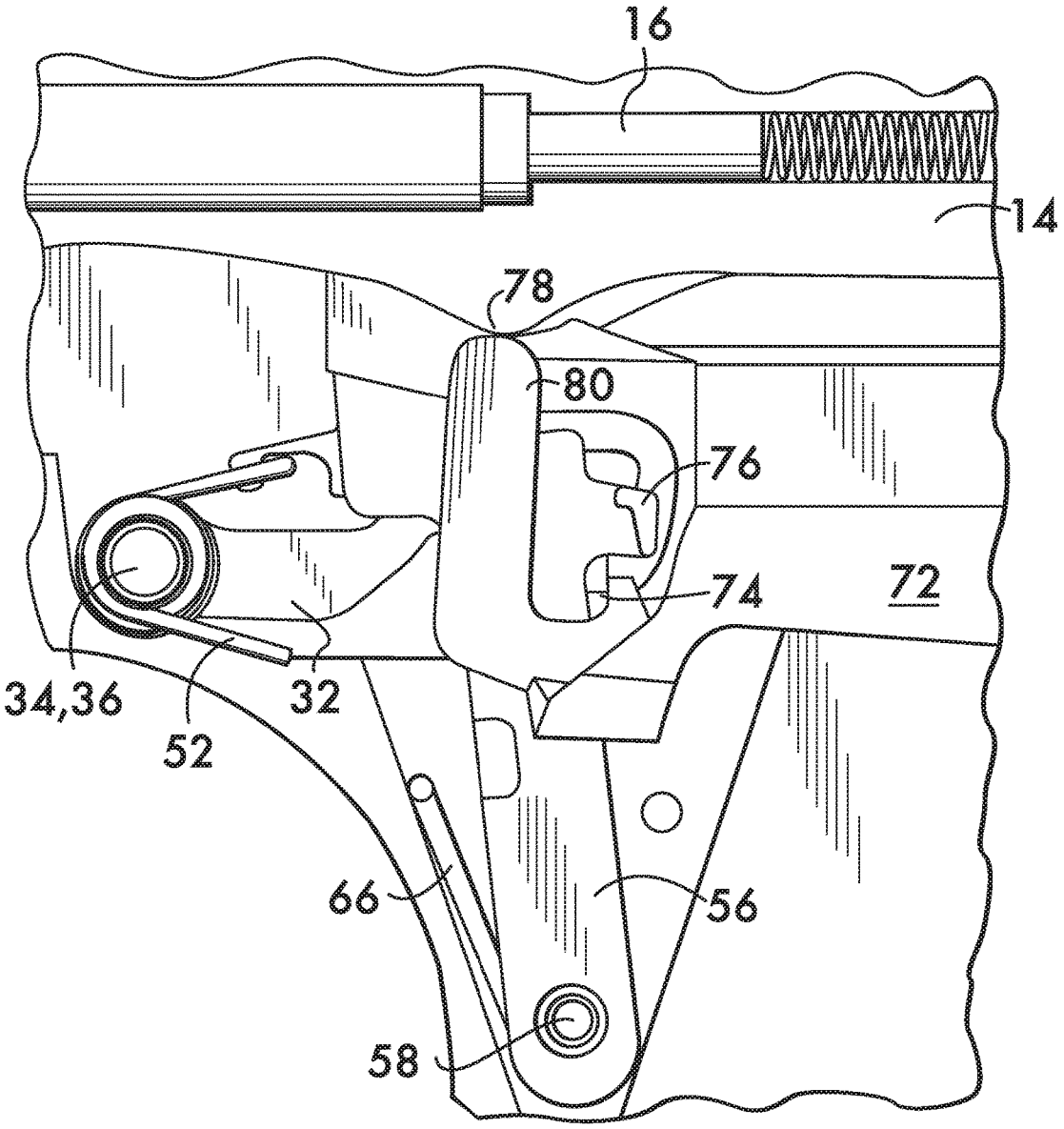
FIG. 10 is a side view showing various components of the example sear mechanism according to the invention on an enlarged scale.
Figure 11:
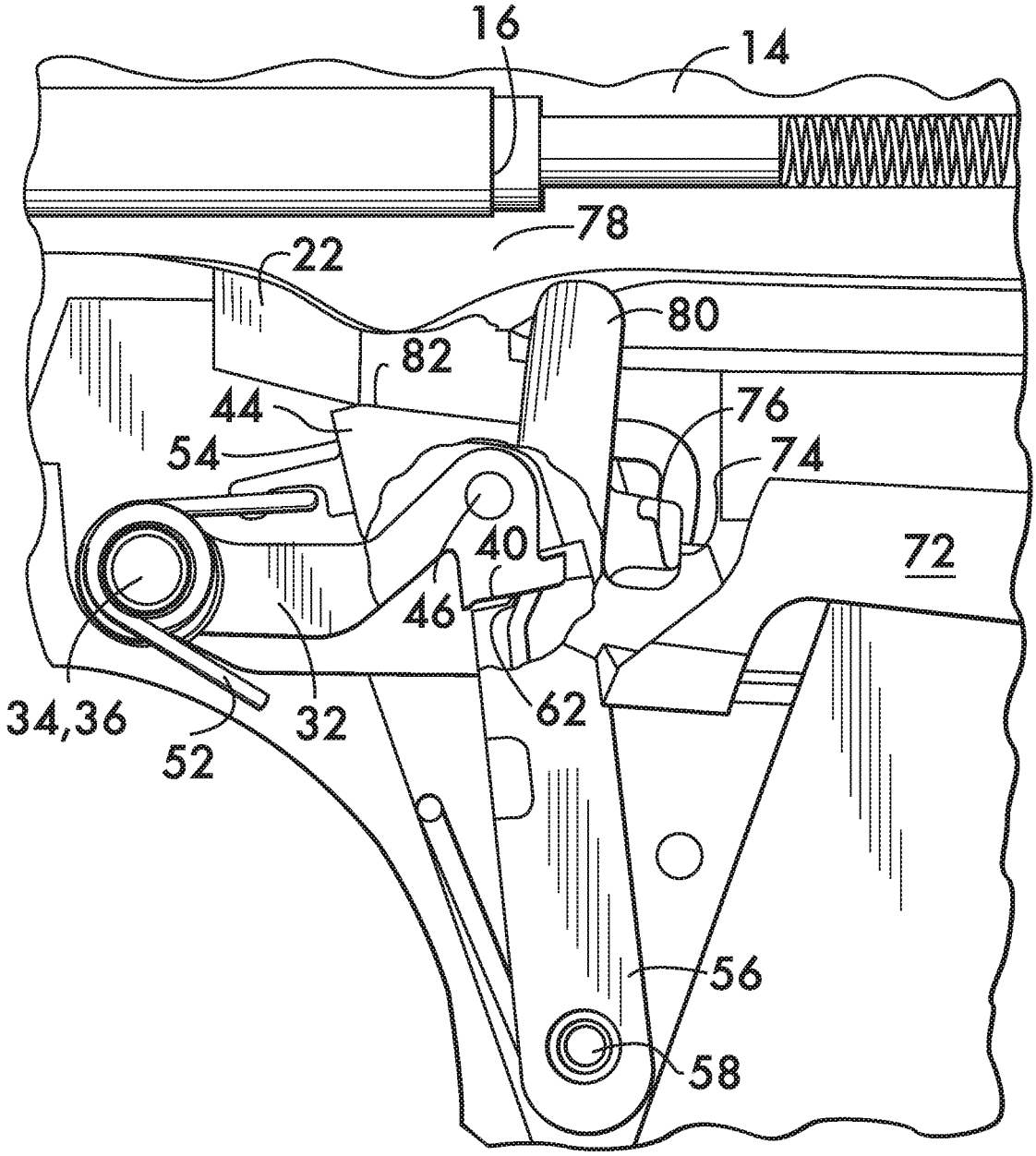
FIG. 11 is a side view showing various components of the example sear mechanism according to the invention on an enlarged scale.

FIGS. 2, 6 and 7 illustrate the interaction between the sear lever 32 and the actuator lever 56 as the trigger 68 is pulled. Pulling the trigger 68 moves the forcing surface 74 of the trigger bar 72 into engagement with the tab 76 of the actuator lever 56, rotating the actuator lever counterclockwise about its actuator axis 58. This rotation causes the support surface 62 on the actuator lever 56 to move across the running surface 40 of the sear lever 32 until the ramp surface 64 on the actuator lever 56 engages the contact surface 42 on the sear lever 32 (see FIG. 7). Tactile feedback results from contact between the ramp surface and the contact surface in the form of increased resistance to trigger pull which is felt at this point in the trigger bar travel as the pistol 10 is on the verge of firing. FIG. 8 shows the sear mechanism 28 just as the contact surface 42 has fallen off of the ramp surface 64, thereby allowing the sear lever 32 to rotate clockwise about its lever axis 34. The sear body 44 rotates with the sear lever 32 which allows the action surface 54 to fall off of the striker face 24 and release the striker 16 to discharge the pistol 10. FIG. 9 shows the spur 22 of striker 16 after the striker has moved toward the muzzle end 26 of the pistol 10 to discharge a chambered round (not shown). With the sear body 44 free of the spur 22 the sear lever 32 is free to rotate counterclockwise under the biasing force of sear spring 52 back to the ready position shown in FIG. 2. As shown in FIG. 3, the counterclockwise rotation of the sear lever 32 is limited by engagement between the mounting pin 48 and the stop surface 59 on the actuator lever 56. FIG. 10 shows the slide 14 moving out of battery (to the left) under recoil force from the discharged round. During motion of slide 14 a cam 78 on the slide 14 engages a cam follower 80 on the trigger bar 72. This pivots the trigger bar 74 counterclockwise and disengages the trigger bar forcing surface 74 from the tab 76 of the actuator lever 56, thereby permitting the actuator lever to rotate clockwise about actuator axis 58 under the force of actuator spring 66 and back into the ready position shown in FIG. 2. As shown in FIG. 11 this rotation reengages the support surface 62 on the actuator lever 56 with the running surface 40 on the sear lever 32 thereby restraining the sear lever 32 from rotating. Contemporaneously, the spur 22 of the striker 16, moving with the slide 14 as it moves out of battery, engages a top surface 82 of the sear body 44 (see also FIG. 3), which pivots the sear body 44 counterclockwise about sear axis 46 to allow the spur 22 to pass. Once the spur 22 is clear of the sear body 44 the sear spring 52 rotates the sear body 44 clockwise and into the ready position shown in FIG. 2. Thus as the slide 14 moves back into battery (to the right) under the force of the slide return spring (not shown) the spur 22 catches on the sear body's action surface 54, preventing further motion of the striker 16 and thereby compressing the striker spring 18 and cocking the striker as the slide 14 moves into battery.

What is claimed is:

1. A sear mechanism for a firearm having a frame and a striker, said sear mechanism comprising:

a sear lever mountable on said frame for pivoting motion about a lever axis;

a stop surface positioned on said sear lever distal to said lever axis and facing said striker;

a running surface positioned on said sear lever distal to said lever axis and facing away from said striker;

a contact surface positioned on said sear lever contiguous with said running surface, said contact surface being angularly oriented with respect to said running surface;

a sear body mounted on said sear lever for pivoting motion about a sear axis distal to said lever axis;

an engagement surface positioned on said sear body distal to said sear axis, said engagement surface facing said stop surface;

a sear spring acting on said sear body to bias said engagement surface toward said stop surface;

an action surface positioned on said sear body, said action surface being engageable with said striker;

an actuator lever mountable on said frame for pivoting motion about an actuator axis;

a support surface positioned on said actuator lever in facing relation with said running surface;

a ramp surface positioned on said actuator lever contiguous with said support surface, said ramp surface being angularly oriented with respect to said support surface and engageable with said contact surface upon pivoting motion of said actuator lever; and an actuator spring acting on said actuator lever to bias said ramp surface away from said contact surface.

2. The sear mechanism according to claim 1, further comprising a housing mountable on said frame, said sear lever and said actuator lever being pivotably mounted within said housing.

3. The sear mechanism according to claim 2, wherein said sear spring acts between said housing and said sear body.

4. The sear mechanism according to claim 2, wherein said actuator spring acts between said housing and said actuator lever.

5. The sear mechanism according to claim 1, wherein said ramp surface has an orientation angle complementary to an orientation angle of said contact surface.

6. A firearm, said firearm comprising:

a frame;

a slide mounted on said frame and movable between a position in battery and a position out of battery;

a striker mounted on said slide, said striker defining a striker face facing a muzzle end of said firearm;

a sear lever mounted on said frame for pivoting motion about a lever axis;

a stop surface positioned on said sear lever distal to said lever axis and facing said striker;

a running surface positioned on said sear lever distal to said lever axis and facing away from said striker;

a contact surface positioned on said sear lever contiguous with said running surface, said contact surface being angularly oriented with respect to said running surface;

a sear body mounted on said sear lever for pivoting motion about a sear axis distal to said lever axis;

an engagement surface positioned on said sear body distal to said sear axis, said engagement surface facing said stop surface;

a sear spring acting on said sear body to bias said engagement surface toward said stop surface;

an action surface positioned on said sear body, said action surface being engageable with said striker face;

an actuator lever mounted on said frame for pivoting motion about an actuator axis;

a support surface positioned on said actuator lever in facing relation with said running surface;

a ramp surface positioned on said actuator lever contiguous with said support surface, said ramp surface being angularly oriented with respect to said support surface and engageable with said contact surface upon pivoting motion of said actuator lever;

an actuator spring acting on said actuator lever to bias said ramp surface away from said contact surface;

a trigger pivotably mounted on said frame;

a trigger bar pivotably linked to said trigger, said trigger bar being movable into engagement with and pivoting said actuator lever when said trigger is pulled.

7. The firearm according to claim 6, further comprising a housing mounted on said frame, said sear lever and said actuator lever being pivotably mounted within said housing.

8. The firearm according to claim 7, wherein said sear spring acts between said housing and said sear body.

9. The firearm according to claim 7, wherein said actuator spring acts between said housing and said actuator lever.

10. The firearm according to claim 6, wherein said ramp surface has an orientation angle complementary to an orientation angle of said contact surface.

11. The firearm according to claim 6, wherein said striker comprises a shaft and a spur projecting outwardly therefrom, said striker face being positioned on said spur.

12. The firearm according to claim 6, wherein said actuator lever comprises a tab projecting therefrom, said trigger bar comprising a forcing surface engageable with said tab for pivoting said actuator lever upon motion of said trigger bar.

13. The firearm according to claim 6, wherein said firearm comprises a semiautomatic pistol.

* * * * *